US006685078B2

(12) United States Patent
Wohlwend et al.

(10) Patent No.: US 6,685,078 B2
(45) Date of Patent: Feb. 3, 2004

(54) SETTING TOOL

(75) Inventors: Norbert Wohlwend, Nendeln (LI); Dionys Schalbetter, Haag (CH); Johann Büchel, Sevelen (CH); Robert Jakob, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 50 days.

(21) Appl. No.: 10/075,496

(22) Filed: Feb. 13, 2002

(65) Prior Publication Data

US 2002/0113113 A1 Aug. 22, 2002

(30) Foreign Application Priority Data

Feb. 16, 2001 (DE) ..... 101 07 887

(51) Int. Cl.[7] ..... B25C 3/00

(52) U.S. Cl. ..... 227/120; 227/109; 227/135; 227/136

(58) Field of Search ..... 227/9, 10, 11, 227/136, 109, 120, 135

(56) References Cited

U.S. PATENT DOCUMENTS 3,991,925 A * 11/1976 Buchel ..... 227/10
4,051,990 A 10/1977 Chromy et al.
4,201,324 A * 5/1980 Maier et al. ..... 227/9
4,925,082 A * 5/1990 Kim ..... 227/120
4,930,673 A * 6/1990 Pfister ..... 227/10
4,932,580 A * 6/1990 Pfister et al. ..... 227/10
5,180,091 A * 1/1993 Ota ..... 227/8
5,433,367 A * 7/1995 Liu ..... 227/120
5,597,972 A * 1/1997 Wachter ..... 89/1.14
5,615,819 A * 4/1997 Hou et al. ..... 227/109
5,816,469 A * 10/1998 Ohuchi ..... 227/119
5,829,661 A * 11/1998 Hirtl et al. ..... 227/10
5,975,399 A 11/1999 Oehri et al.

FOREIGN PATENT DOCUMENTS

EP 0972951 1/2000

* cited by examiner

*Primary Examiner*—Scott A. Smith
*Assistant Examiner*—Chukwurah Nathaniel
(74) *Attorney, Agent, or Firm*—Sidley Austin Brown & Wood, LLP

(57) ABSTRACT

A setting tool including a stud guide (2) located in the tool housing (1), a hopper (3) extending sidewise of the stud guide and having a guide channel extending parallel to a longitudinal extent of the hopper (3) and having two guide regions (4, 5), a displaceable drawer (9) arranged in the guide channel, a scroll spring (7) provided in the drawer (9) for retaining the drawer (9) in its initial position and having its free end secured to the hopper (3), a cover (13) for closing the hopper and displaceable along the hopper (3) between closed and open positions, the cover (13) having an element (14) for displacing the drawer (9) from its initial position to its transporting position in which the drawer (9) clears a section of the guide channel for insertion of the nail magazine, and elements (6, 20) for formlockingly connecting the drawer (9) to the hopper (3) in the transporting position of the drawer (9).

7 Claims, 4 Drawing Sheets

SETTING TOOL

BACKGROUND OF THE INVENTION

1. Field of the Invention

The present invention relates to a setting tool having a housing, a stud guide located in the housing, a hopper extending sidewise of the stud guide for receiving a nail magazine, the hopper having a guide channel extending parallel to a longitudinal extent of the hopper and having two guide regions spaced from each other in a direction parallel to a setting direction of the setting tool and extending along the guide channel, a displaceable drawer arranged in the guide channel and having a scroll spring for retaining the drawer in its initial position, and a cover for closing the hopper and displaceable along the hopper between a closed position, in which the cover closes the hopper, and an open position in which the nail magazine can be inserted into the hopper, the cover having means for displacing the drawer from its initial position to its transporting position in which the drawer clears a section of the guide channel for insertion of the nail magazine.

2. Description of the Prior Act

For driving fastening elements such as, e.g., nails in hard constructional materials such as concrete, stone, steel, and the like, gas or explosive powder charge-operated setting tools are used. As upon completion of each setting process, another nail should be pushed in a bolt or stud guide, the setting tools are equipped with a hopper projecting sidewise of the stud guide and serving for receiving a strip-shaped nail magazine and guiding the same. The delivery or transporting of separate nails of the nail magazine in a direction toward the stud guide is effected by a transporting device in form of a spring-biased drawer likewise provided in the hopper.

Such a hopper is produced, e.g., by a firm HILTI AG, Shaan, Liechtenstein and which is designated X-AM72. The hopper has a guide channel extending parallel to a longitudinal extent of the hopper and having two guide regions. The guide regions are spaced from each other in a direction parallel to the setting direction and extend along the guide channel. A drawer is arranged in the guide channel and is displaceable by a scroll spring toward the stud guide. The scroll spring axle is arranged in the drawer, and the free end of the spring is secured to the hopper in a region of the hopper adjacent to the stud guide. The hopper is provided with a cover displaceable along the hopper and which, in its closed position, closes at least an end region of the hopper remote from the stud guide. Upon displacement of the cover to its open position, the drawer is also displaced into a position in which it clears a section of the guide channel, and the scroll spring is tensioned. In this position of the drawer, a strip-shaped nail magazine is inserted in the guide channel of the hopper.

An object of the present invention is to provide a setting tool with a hopper that can be easily produced, has a high ruggedness, in which the nail magazine can be inserted by both a right-hander and a left-hander, in which the cover can be displaced in its closed position with a small force, and which would provide indication to the tool user when a new nail magazine should be inserted.

SUMMARY OF THE INVENTION

This and other objects of the present invention, which will become apparent hereinafter, are achieved by providing a setting tool of the type described above and in which the drawer is displaced into its transporting against the biasing force of the scroll spring, and is formlocking connected to the hopper in the transporting position.

Due to the connection of the free end of the scroll spring to the hopper in the region of the stud guide, the scroll spring is loaded when the cover, together with the drawer, are displaced in the position corresponding to the open position of the cover and the transporting position of the drawer. Because of the formlocking or positive connection of the drawer with the hopper in the transporting position of the drawer, a very small force is necessary for displacement of the cover in the direction toward the stud guide, i.e., in its closed position.

Advantageously, for effecting a formlocking connection of the drawer to the hopper, there is provided a two-arm retaining clip associated with the hopper and opening toward the stud guide, with the arms being elastic in a direction transverse to the setting direction and transverse to the longitudinal extent of the hopper. The drawer is provided with two openings in which free ends of the two arms engage, respectively, in the transporting position of the drawer for formlocking connection the drawer with the hopper.

For obtaining a formlocking connection, e.g., two adjacent holding noses provided in the free end regions of the two arms, respectively, can be used.

Preferably, the hopper has a substantially U-shaped cross-section opening in a direction opposite the setting direction.

The U-shaped cross-section makes the hopper more rigid and permits to insert the nail magazine in the hopper in a direction parallel to the setting direction.

For guiding the nail magazine and for providing a sidewise support for the nail magazine in the hopper, the two guide regions are used each of which is formed of two spaced from each other guide surfaces. The distance between the two guide surfaces in both guide region corresponds, e.g., substantially to the diameter of the nail body. However, the distance between the two guide surfaces can be different in the two guide regions. This is, e.g., the case when separate nails of the nail magazine extend through separate guide sleeves connected with each other and guided by at least one guide region.

To prevent penetration of dirt in the hopper when the cover is in its closed position, and to provide for an easy displacement of the cover along the hopper, the hopper has, at its outer contour, in an end region remote from setting tool mouth, on its both sides, guide grooves, respectively, extending along the hopper, and the cover has guide strips projecting into the grooves for guiding the cover along the hopper. The two guide grooves are open toward the free end of the hopper. The two guide strips of the cover extend up to the end region of the cover adjacent to the stud guide.

For releasing the formlocking connection between the drawer and the hopper, the cover is provided with a pressure member for displacing the drawer, when it is located in its transporting position, in a direction toward the steel guide upon displacement of the cover from its open position into its closed position, a distance corresponding at least to a length of an opening formed in the drawer and measured in a direction transverse to the setting direction. Shortly before the cover reaches its closed position, the drawer is displaced toward the stud guide by a distance at which the formlocking connection between the drawer and the hopper is released. As a result, the loaded scroll spring can pull the drawer further toward the stud guide until the drawer adjoins the nail magazine.

For manufacturing reasons, the pressure member is provided at an end of the cover remote from the stud guide and projects from the cover in the direction toward the stud guide.

In order to provide an indication to the user when a new nail magazine need be inserted, without displacing the cover, there is provided in the hopper a viewing window. Through the window, the user can see, e.g., the position of the drawer. E.g., when the drawer becomes visible to the user, it means that a new magazine is to be inserted.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 3:
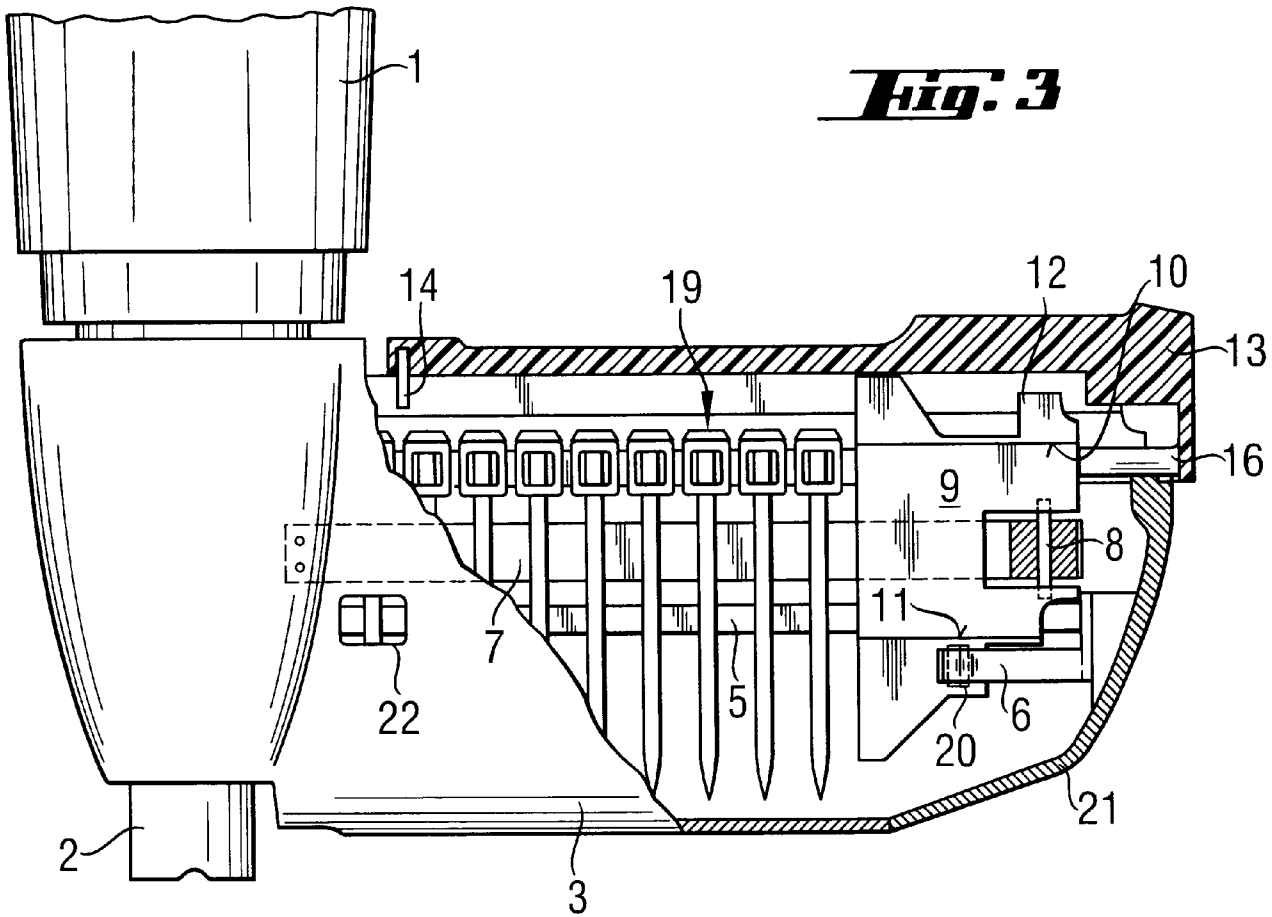
FIG. 3 a partially cross-sectional view of a portion of the setting tool shown in FIG. 1, with the cover being almost closed and pressed in the setting direction against a drawer.

A setting told according to the present invention, which is shown in the figures, includes a housing 1, a stud guide 2 located in the housing 1 and having a receiving core 18, and a hopper 3 extending sidewise of the stud guide 2. The stud guide 2 is displaceable parallel to the setting direction. The hopper 3 serves for receiving and guiding a nail magazine 19 in which a plurality arranged one after another nails are releasably connected with each other. The nail magazine 19 is shown in FIG. 3.

The hopper 3 has, in the region of the stud guide 2, a through-bore which extends parallel to the setting direction and through which the stud guide 2 projects. The hopper 3 is fixedly connected with the stud guide 2. A guide channel, which is provided in the hopper 3 for receiving the nail magazine 19, extends transverse to the setting direction. The hopper 3 has substantially a U-shaped cross-section opening in a direction opposite the setting direction. At its end remote from the stud guide 2, the hopper 3 is closed, e.g., with a detachable cover 21.

Figure 4:
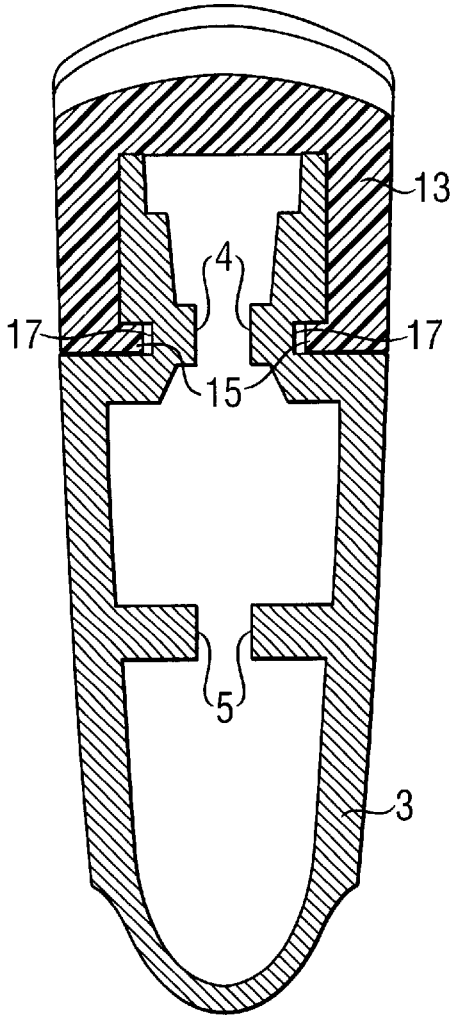
FIG. 4 a cross-sectional view alone line IV—IV in FIG. 1.
Figure 5:
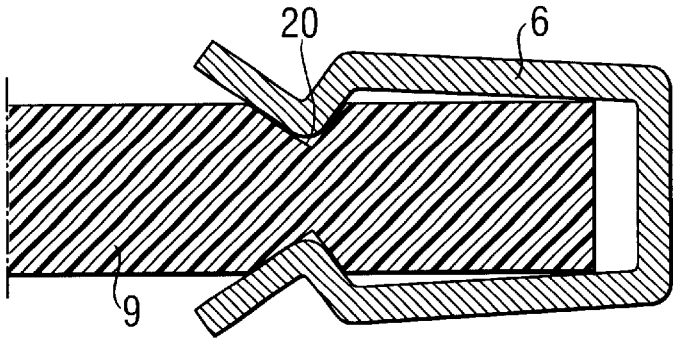
FIG. 5 a cross-sectional view along line V—V in FIG. 2.

The hopper guide channel has two guide regions 4 and 5 spaced from each other in a direction parallel to the setting direction. Each of the guide regions 4 and 5 is formed by two, spaced from each other, guide surfaces. The distance between the two guide surfaces corresponds, e.g., in the guide regions 4 and 5, substantially to the diameter of the body of a nail to be handled by the setting tool. It is, however, possible to have different spacings between the guide surfaces of the two guide regions 4 and 5, respectively. This is the case when the separate nails of a nail magazine extend, respectively, through one of a plurality of connected with each other guide sleeves which are guided by at least one guide region. According to FIG. 4, the distance between the guide surfaces of both guide regions 4 and 5 is the same.

In the guide channel, there is provided a drawer 9 displaceable along the guide channel. The drawer 9 is provided, on its side surfaces adjacent to the separate guide surfaces, with a first guide edge 10 and a second guide edge 11 which support the drawer 9 on the hopper 3 in a direction extending parallel to the setting direction. In an end region of the drawer 9 remote from the stud guide 2, an axle of a scroll spring 7, which extends in a direction parallel to the setting direction, is rotatably supported. A free end of the roll spring 7 is arranged on the hopper 3 in the region of the stud guide 2. With respect to a direction parallel to the setting direction, the scroll spring 7 is located between the two guide regions 4 and 5.

In its end region remote from the setting tool mouth, the hopper 3 has, on opposite sides thereof, respectively, guide grooves 17 which extend along the hopper 3 and which are open at the free end of the hopper 3 remote from the stud guide 2.

The open surface of the hopper 3 can be closed by a cover 13 displaceable along the hopper 3. The cover 13 has a substantially U-shaped cross-section opening in the setting direction. The end regions of both legs of the cover 13, which face in the setting direction, are provided on their inner sides, respectively, with guide strips 15 which extend along the cover 13 and serve for guiding the cover 13 along the hopper 3. The cross-section of the guide strips 15 corresponds to the cross-section of the guide groove 17 of the hopper 3, whereby on one hand, a smooth displacement of the cover 13 along the hopper 3 is possible and, on the other hand, penetration of dirt inside the hopper 3 is prevented.

A stop 12 projects from the drawer 9 in a direction opposite the setting direction. The stop 12 cooperates with a dog 14 provided at the end of the cover 13 adjacent to the stud guide 2. In the end region of the cover 13 remote from the stud guide 2, there is provided, e.g., a pin-shaped pressure member 16 projecting from the cover 13 in the direction of the stud guide 2. As it has already been discussed above, at the end of the hopper 3 remote form the stud guide, there is provided a detachable cover 21. A retaining clip 6, which is adapted to cooperate with the drawer 9, projects from the detachable cover 21 in the direction of the stud guide 2.

The retaining clip 6 has two arms elastical in the direction transverse to the setting direction and transverse to the extension of the hopper 3. The free end regions of the two arms, adjacent to the stud guide 2, are provided with holding noses adjacent to each other and adapted to cooperate with openings 20 provided in the drawer 9. The functions of the pressure member 16 and the retaining clip 6 will be discussed further below.

The hopper 3 is provided with a viewing window 22 through which a position of the drawer 9 can be seen. When the drawer 9 can be seen by a setting tool user, it means that a new nail magazine 19 must be inserted in the hopper 3.

Figure 1:
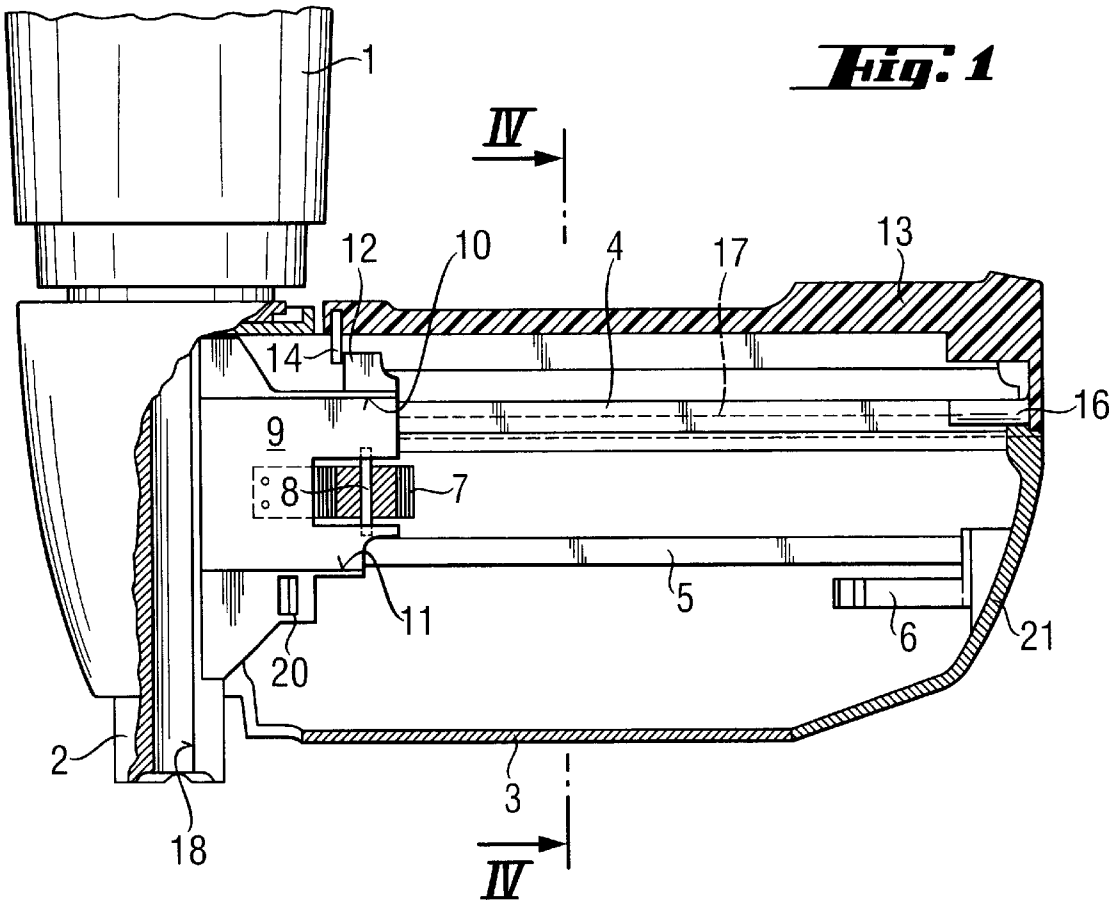
FIG. 1 a partially cross-sectional side view of a portion of a setting tool according to the present invention with the cover of the tool hopper being closed.
Figure 2:
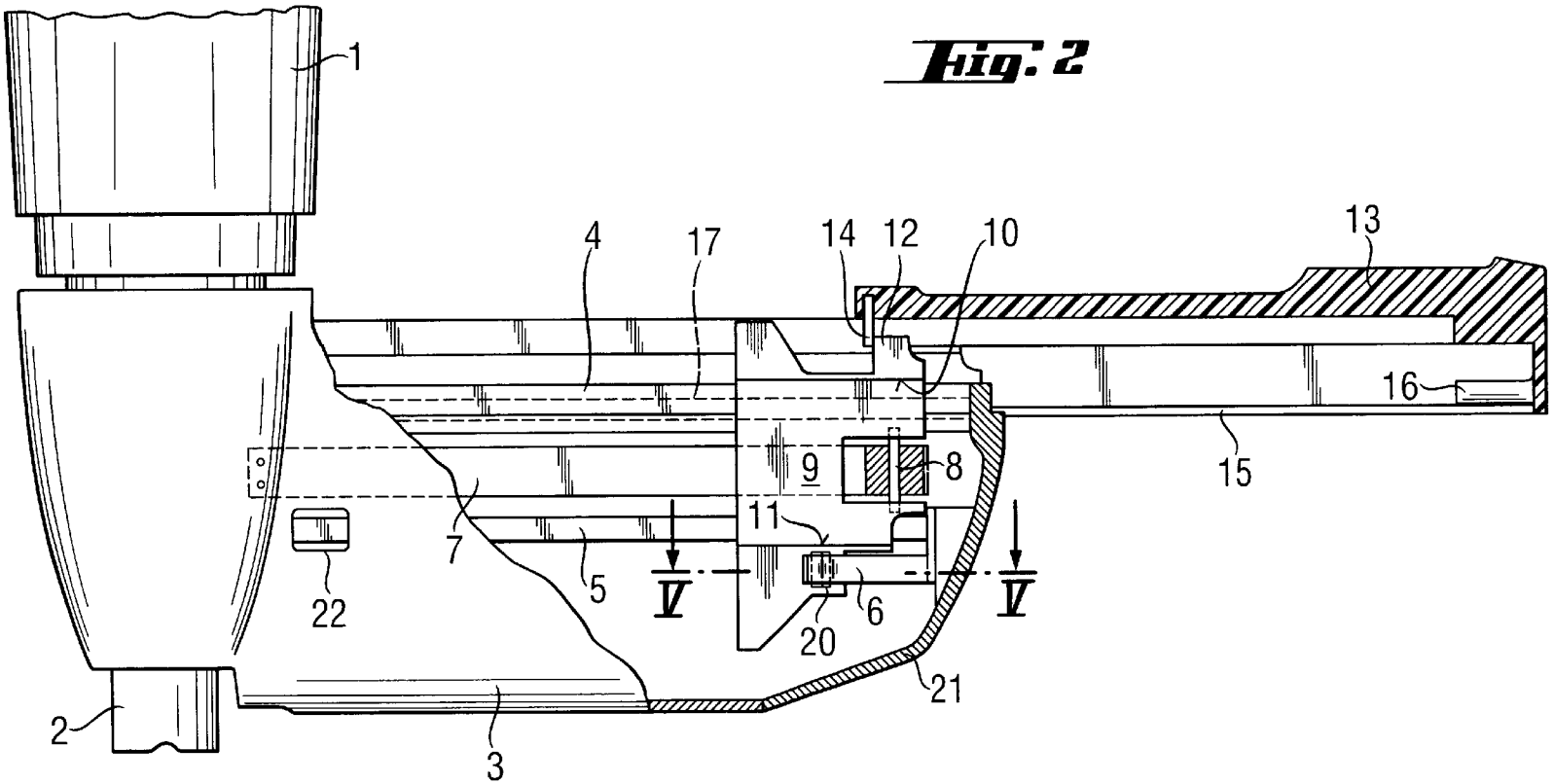
FIG. 2 a partially cross-sectional view of the portion of the setting tool shown in FIG. 1 but with the hopper cover being open.

FIG. 1 shows the cover 13 in its closed position. The drawer 9 is located in its initial position in the region of the stud guide 2. The scroll spring 7 is in its released position, being completely rolled up. In order to insert the nail magazine 19 in the guide channel of the hopper 3 in the setting direction, it is necessary to displace the cover 13 away from the guide 2 to its open position. Upon displacement of the cover 13 into its open position shown in FIG. 2, the dog 14, which is provided in the cover 13, comes into contact with the stop 12 of the drawer 9. This results in displacement of the drawer 9 in the same direction as the cover 13 until the drawer 9 reaches a position in which the scroll spring 7 is preloaded.

When the drawer 9 reaches this position, the holding noses of the retaining clip 6 engage sidewise in the openings 20 in the drawer 9, retaining the drawer 9. This engagement prevents the drawer 9 from being displaced back by the scroll spring 7 into its initial position. In the open position of the cover 13, the nail magazine 19 can be inserted into the guide channel of the hopper 3.

After the nail magazine 19 has been inserted in the hopper 3, the hopper 3 is closed by displacement of the cover 13 into its closed position, as shown in FIG. 3. Shortly before the cover 13 reaches its closed position, the pressure member 16, which is provided on the cover 13, engages the drawer 9 and pushes it back in the direction of the stud guide 2. The drawer 9 is displaced in the direction of the stud guide 2 until the connection between the drawer 9 and the retaining clip 6 is broken. Upon breaking of the connection of the clip 6 with the drawer 9, the scroll spring 7 pulls the drawer 9 in the direction toward the stud guide 2 until the drawer 9 is lined up with the nail magazine 19.

Though the present invention was shown and described with references to the preferred embodiment, such are merely illustrative of the present invention and are not to be construed as a limitation thereof, and various modifications to the present invention will be apparent to those skilled in the art. It is, therefore, not intended that the present invention be limited to the disclosed embodiment or details thereof, and the present invention includes all of various and/or alternative embodiments within the spirit and scope of the present invention as defined by the appended claims.

What is claimed is:

1. A setting tool, comprising a housing (1); a stud guide (2) located in the housing (1); a hopper (3) extending sidewise of the stud guide (2) for receiving a nail magazine (19) and having a substantially U-shaped cross-section that opens in a direction opposite a setting direction of the setting tool, the hopper (3) having a guide channel extending parallel to a longitudinal extent of the hopper (3) and having two guide regions (4, 5) spaced from each other in a direction parallel to the setting direction of the setting tool and extending along the guide channel; a drawer (9) arranged in the guide channel and displaceable between an initial position, in which the drawer (9) adjoins a space in which the nail magazine is received, and a transporting position; a scroll spring (7) provided in the drawer (9) for retaining the drawer (9) in its initial position and having a free end thereof secured to the hopper (3) in a region of the hopper (3) adjacent to the stud guide (2); a cover (13) having a substantially U-shaped cross-section substantially complementary to that of the hopper and that opens in the setting direction of the setting tool for closing the hopper (3) and displaceable along the hopper (3) between a closed position, in which the cover (13) closes the hopper (3), and an open position in which the nail magazine can be inserted into the hopper (3), the cover (13) having means (14) for displacing the drawer (9), upon displacement of the cover (13) to its open position, from its initial position to its transporting position in which the drawer (9) clears a section of the guide channel for insertion of the nail magazine; and means (6, 20) for formlockingly connecting the drawer (9) to the hopper (3) in the transporting position of the drawer (9).

2. A setting tool according to claim 1, wherein each of the two guide regions (4, 5) of the guide channel is formed of two spaced from each other guide surfaces.

3. A setting tool according to claim 1, wherein the cover (13) is provided with a pressure member (16) for displacing the drawer (9), which is located in its transporting position, in a direction toward the stud guide (2) upon displacement of the cover (13) from its open position into its closed position, a distance corresponding at least to a length of an opening (20) formed in the drawer (9) and measured in a direction transverse to the setting direction.

4. A setting tool according to claim 3, wherein the pressure member (16) is provided at an end of the cover (13) remote from the stud guide (2) and projects in a direction toward the stud guide (2).

5. A setting tool according to claim 1, wherein the hopper (3) has a viewing window (22) for monitoring a position of the drawer (9).

6. A setting tool, comprising a housing (1); a stud guide (2) located in the housing (1); a hopper (3) extending sidewise of the stud guide (2) for receiving a nail magazine (19), the hopper (3) having a guide channel extending parallel to a longitudinal extent of the hopper (3) and having two guide regions (4, 5) spaced from each other in a direction parallel to a setting direction of the setting tool and extending a long the guide channel; a drawer (9) arranged in the guide channel and displaceable between an initial position, in which the drawer (9) adjoins a space in which the nail magazine is received, and a transporting position; a scroll spring (7) provided in the drawer (9) for retaining the drawer (9) in its initial position and having a free end thereof secured to the hopper (3) in a region of the hopper (3) adjacent to the stud guide (2); a cover (13) for closing the hopper (3) and displaceable along the hopper (3) between a closed position, in which the cover (13) closes the hopper (3), and an open position in which the nail magazine can be inserted into the hopper (3), the cover (13) having means (14) for displacing the drawer (9), upon displacement of the cover (13) to its open position, from its initial position to its transporting position in which the drawer (9) clears a section of the guide channel for insertion of the nail magazine; and means (6, 20) for formlockingly connecting the drawer (9) to the hopper (3) in the transporting position of the drawer (9), wherein the formlockingly connecting means comprises a two-arm retaining clip (6) associated with the hopper (3) and opening toward the stud guide (2), with the arms being elastic in a direction transverse to the setting direction and transverse to the longitudinal extent of the hopper (3), and two openings (2) provided in the drawer (9) and in which free ends of the two arms engage, respectively, in the transporting position of the drawer (9) for formlockingly connecting the drawer (9) with the hopper (3).

7. A setting tool, comprising a housing (1); a stud guide (2) located in the housing (1); a hopper (3) extending sidewise of the stud guide (2) for receiving a nail magazine (19), the hopper (3) having a guide channel extending parallel to a longitudinal extent of the hopper (3) and having two guide regions (4, 5) spaced from each other in a direction parallel to a selling direction of the selling tool and extending a long the guide channel; a drawer (9) arranged in the guide channel and displaceable between an initial position, in which the drawer (9) adjoins a space in which the nail magazine is received, and a transporting position; a scroll spring (7) provided in the drawer (9) for retaining the drawer (9) in its initial position and having a free end thereof secured to the hopper (3) in a region of the hopper (3) adjacent to the stud guide (2); a cover (13) for closing the hopper (3) and displaceable along the hopper (3) between a closed position, in which the cover (13) closes the hopper (3), and an open position in which the nail magazine can be inserted into the hopper (3), the cover (13) having means (14) for displacing the drawer (9), upon displacement of the cover (13) to its open position, from its initial position to its transporting position in which the drawer (9) clears a section of the guide channel for insertion of the nail magazine; and means (6, 20) for formlockingly connecting the drawer (9) to the hopper (3) in the transporting position of the drawer (9), wherein the hopper (3) has, at an outer contour thereof in an end region remote from setting tool mouth, on both sides thereof, guide grooves (17), respectively, extending along the hopper (3), and the cover (13) has guide strips (15) projecting into the grooves (17) for guiding the cover (13) along the hopper (3).

* * * * *